US006942174B2

(12) United States Patent
Brenk

(10) Patent No.: US 6,942,174 B2
(45) Date of Patent: Sep. 13, 2005

(54) APPARATUS FOR WINDING A THREAD RESERVE AND A CROSS-WOUND BOBBIN ONTO A BOBBIN TUBE

(75) Inventor: Siegfried Brenk, Krefeld (DE)

(73) Assignee: Saurer GmbH & Co. KG (DE)

( * ) Notice: Subject to any disclaimer, the term of this patent is extended or adjusted under 35 U.S.C. 154(b) by 0 days.

(21) Appl. No.: 10/955,288

(22) Filed: Sep. 30, 2004

(65) Prior Publication Data

US 2005/0082416 A1 Apr. 21, 2005

(30) Foreign Application Priority Data

Oct. 4, 2003 (DE) ..... 103 46 096

(51) Int. Cl.[7] ..... B65H 54/22; B65H 65/00

(52) U.S. Cl. ..... 242/476.2; 242/476.6; 242/473.8; 242/474.6; 242/481; 242/476.5

(58) Field of Search ..... 242/476.2, 476.3, 242/476.4, 476.5, 476.6, 476.7, 473.8, 474.4, 474.5, 474.6, 474.7, 481

(56) References Cited

U.S. PATENT DOCUMENTS 3,941,322 A * 3/1976 Hewitt ..... 242/473.8
5,029,762 A * 7/1991 Behrens et al. ..... 242/473.5
5,511,734 A * 4/1996 Enger et al. ..... 242/476.3
5,681,000 A * 10/1997 Gobbels et al. ..... 242/475.7
6,398,152 B1 * 6/2002 Burchert et al. ..... 242/474.7
6,629,660 B1 * 10/2003 Yamaguchi et al. ..... 242/474.7
6,779,750 B1 * 8/2004 Couchey et al. ..... 242/476.6

FOREIGN PATENT DOCUMENTS

DE 2711024 B * 12/1977 ..... B65H/67/04

* cited by examiner

*Primary Examiner*—Kathy Matecki
*Assistant Examiner*—Evan Langdon
(74) *Attorney, Agent, or Firm*—Robert W Becker & Associates; Robert W. Becker

(57) ABSTRACT

An apparatus for winding a cross-wound bobbin onto a bobbin tube is provided and comprises a bobbin creel including two bobbin creel arms for the mounting of two bobbin tube centering plates, a thread intake device effective in the region of an arm and with which is associated a thread severing device, a drive unit for a bobbin shaft/cross-wound bobbin, and a traversing thread guide adapted to be driven to move back and forth along the bobbin shaft/cross-wound bobbin. A given bobbin creel arm is provided with at least one intake or suction channel that is directed radially inwardly from the periphery of the centering plate and that opens into a hollow shaft guided outwardly through an associated arm. A suction head is adapted to be placed against the hollow shaft and is provided with a thread clamping mechanism and the thread severing device.

12 Claims, 3 Drawing Sheets

APPARATUS FOR WINDING A THREAD RESERVE AND A CROSS-WOUND BOBBIN ONTO A BOBBIN TUBE

BACKGROUND OF THE INVENTION

The present invention relates to an apparatus for winding a thread reserve and a cross-wound bobbin onto a bobbin tube.

With textile machines, for example spinning and twisting machines, the thread is continuously delivered to a bobbin device disposed at each spinning or twisting location, where it is generally wound up to form a cross-wound bobbin. In order for the continuous processing of cross-wound bobbins to provide a knotting possibility in the form of a thread reserve, and to draw off the cross-wound bobbin to the last winding in a disruption-free manner, the thread reserve should comprise a thread that has the same spin or thread twist as does the thread that on the whole is wound up to form the cross-wound bobbin.

A further requirement is that the placement of a thread onto an empty bobbin tube, and the formation of the thread reserve, should be carried out in a substantially automated manner in order on the one hand to relieve the operating personnel and on the other hand to obtain uniform, reproducible results, even for successive winding processes.

With the apparatus pursuant to DE 2 711 024 C2, the start of the thread is brought into the vicinity of a bobbin tube that is provided with holes by means of a gripper arm. By means of a suction line that extends in the bobbin creel arm, and openings disposed at the end face of the centering plate, air is drawn out of the bobbin tube through the centering plate. Due to the air that flows in subsequently from the outside through the holes of the bobbin tube, the start of the thread is drawn into the interior of the bobbin tube, where it is held securely in place, so that the subsequent thread can be wound onto it by rotation of the bobbin tube. Since the start of the thread that is drawn into the bobbin tube is essentially held in place only loosely within the bobbin tube by the intake or suction air, there is no defined binding location of the following spun or twisted thread that would ensure that upon formation of a thread reserve, the latter would have a spin or thread twist that corresponds precisely to that of the thread wound to form the cross-wound bobbin. Aside from this, this known reference describes no measures for building up a thread reserve.

It is therefore an object of the present invention to provide an extensively automatically operating apparatus for first winding a thread reserve and subsequently a cross-wound bobbin onto a bobbin tube such that the thread that is wound to form a thread reserve has a twist that corresponds to the twist of the thread wound to form the cross-wound bobbin.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

The object of the invention is realized by an apparatus that comprises a bobbin creel comprising two bobbin creel arms for the mounting of two bobbin tube centering plates, a thread intake device that is effective in the region of a centering plate and with which is associated a thread severing device, a drive unit for a bobbin shaft/cross-wound bobbin, and a traversing thread guide that is adapted to be driven so as to move back and forth along the bobbin shaft/cross-wound bobbin; a given one of the centering plates is provided with at least one intake or suction channel that is directed radially inwardly from the periphery of the centering plate, wherein the intake or suction channel opens into a hollow shaft that is guided outwardly through an associated one of the bobbin creel arms; and a suction head is provided that is adapted to be placed against the hollow shaft in an axial direction, wherein the suction head is provided with a thread clamping mechanism and the thread severing device.

Due to the fact that the centering plate has an intake or suction channel that is directed radially inwardly, that opens into a centering plate hollow shaft, and against which a suction head can be placed, there is ensured an exact travel of the thread in a direction toward the source of the suction, so that by means of the devices disposed within the suction head for clamping the thread securely in place and cutting it, it is possible to ensure that the thread end, which is held securely in place by the clamping mechanism, has a precisely defined spin or thread twist. In order with this start of the thread to be able to wind up the necessary thread reserve, there is disposed in the region of the centering plate, beyond the traversing path of the traversing thread guide, a hold-back element that is preferably moveable out of a position that guides the thread in the direction of the centering plate and into a position that releases the thread.

The placement of the thread at the suction opening of the intake or suction channel that extends through the centering plate can be effected either manually or in an automated manner by means of known thread placement mechanisms.

Further specific features of the present application will be described in detail subsequently.

DESCRIPTION OF SPECIFIC EMBODIMENTS

Figure 1:
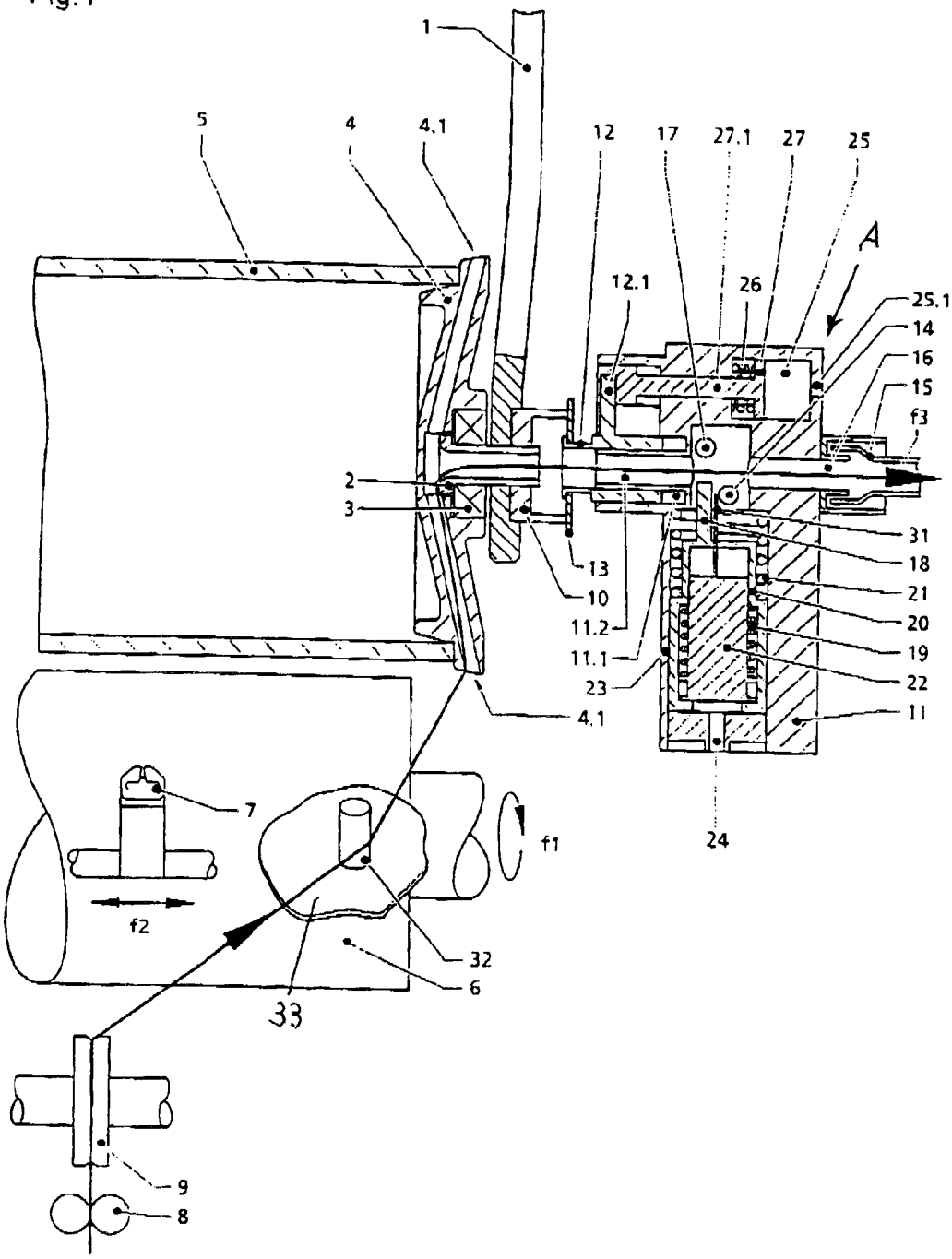
FIG. 1 shows in detail one arm of a bobbin creel having a centering plate secured thereon, and a suction head placed on the centering plate, during the drawing-in of the thread.
Figure 2:
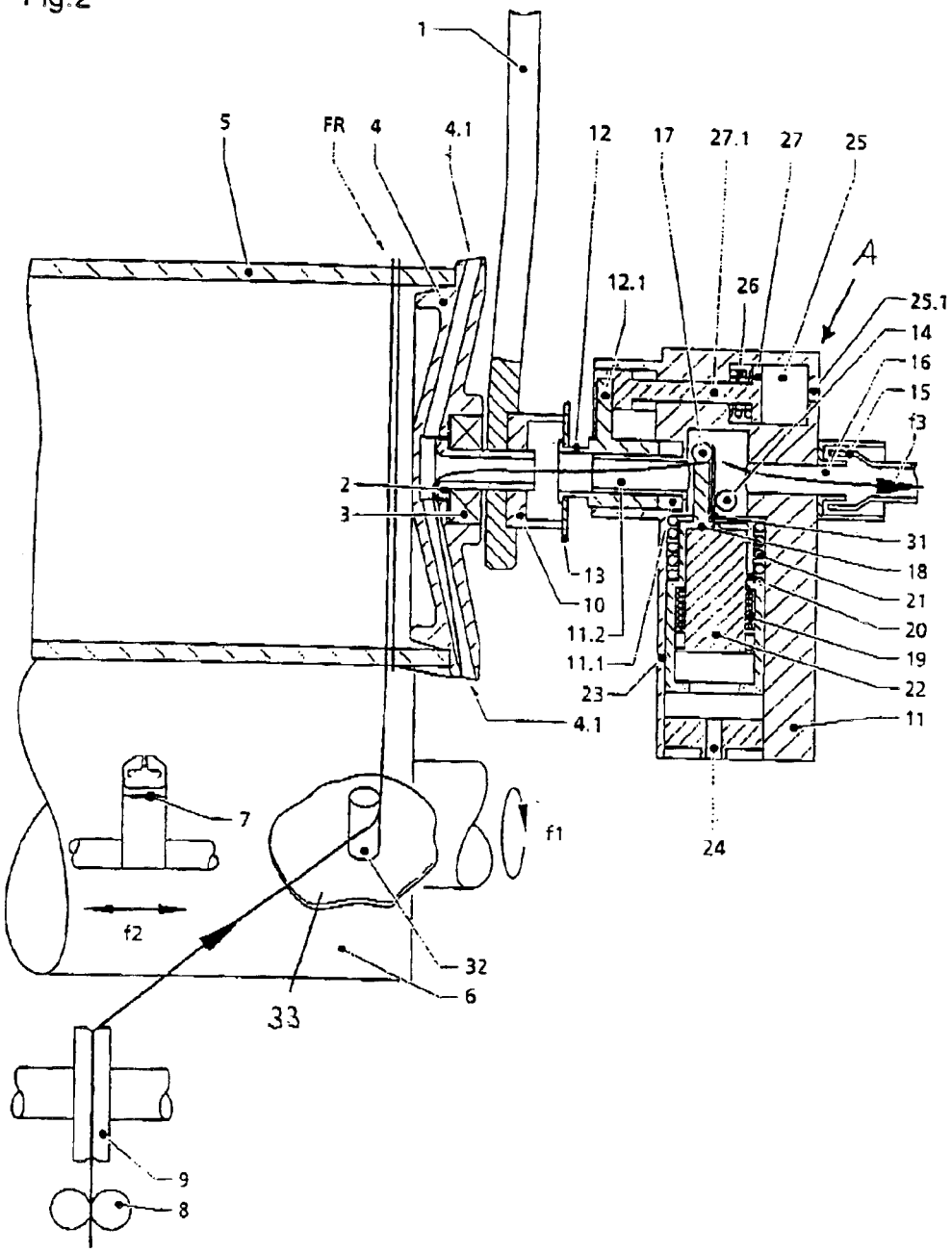
FIG. 2 shows the condition after the thread that has been drawn into the suction head has been securely clamped in place and severed.
Figure 3:
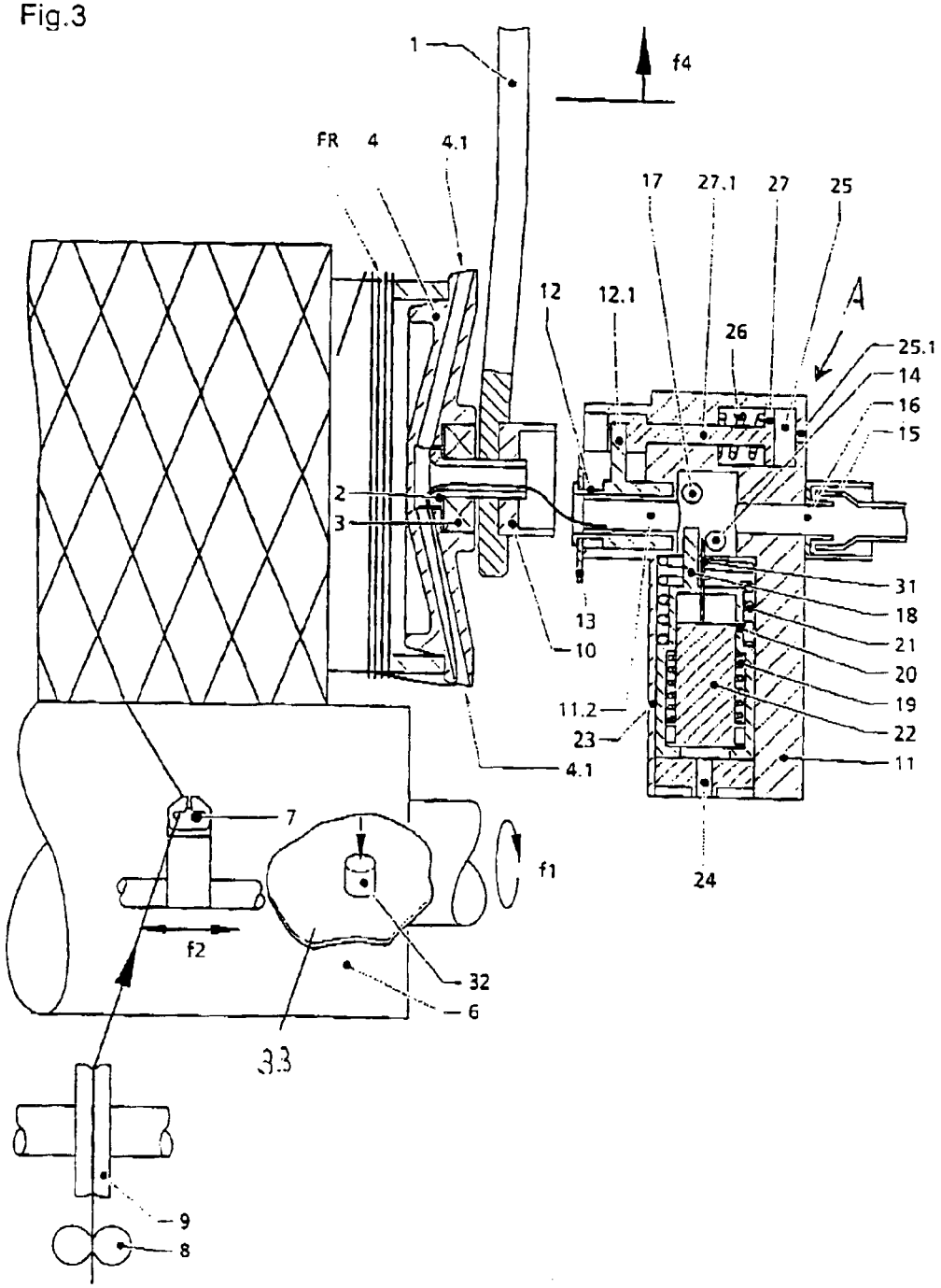
FIG. 3 shows the operating state during the winding-up to form the cross-wound bobbin.

Referring now to the drawings in detail, from a generally known bobbin creel, e.g. from DE 27 11 024 C2, illustrated in FIGS. 1–3 is only one bobbin creel arm 1, which carries a hollow shaft 2. Mounted on this hollow shaft 2, via the bearing 3, is a centering plate 4 that is provided with at least one intake or suction channel 4.1 that extends radially inwardly from the outer periphery of the centering plate. Each intake channel opens into the hollow shaft 2. Disposed on the centering plate 4 is a bobbin tube 5 that can be driven by a friction drive roller 6 that can be driven in the direction of the arrow f1. Associated with the friction drive roller 6 is a traversing thread guide 7 that is movable back and forth in the direction of the double arrow f2. FIG. 1 furthermore shows a thread feeder 8 and a conventional leading roller 9.

The hollow shaft 2 opens into a cylindrical housing 10 that is essentially open at its outer end face.

A suction head A is disposed laterally next to the bobbin creel arm 1. The suction head A has a housing 11 that is provided with an annular chamber 11.1 that is open in a direction toward the centering plate 4 and in which is mounted a suction or intake stub 12 that is displaceable back and forth in the axial direction; at its free end, the intake stub carries a sealing or gasket ring 13 that can be brought to rest against the rim of the cylindrical housing 10. Adjoining the intake stub 12, via a channel 11.2, is a chamber 14 into which opens an intake or suction channel 16 that leads to a compressed air injector 15. When the compressed air injector 15 is supplied with compressed air, an intake or suction air stream is produced that is effective in the direction of the arrow f3, and by means of which the thread end placed at one intake or suction channel 4.1 of the centering plate 4 is drawn into or pulled through the suction head A until it is ensured that the thread end, approximately in the region of the chamber 14, has a proper, precisely defined twist.

In order to fix the thread end in this condition, stationarily mounted within the chamber 14 is a first clamping element 17 against which, as illustrated in FIG. 2, a second, movable clamping element 18 can be placed to securely hold the thread in place. The second clamping element 18 is secured to a cylinder 20 that is adjustable against the force of a return spring 19 and in which is guided a piston 22 that carries a cutting blade 31 and that is adjustable against the force of a return spring 21. The end of the return spring 19 that is associated with the piston 22 is supported against an internal annular shoulder of the cylinder 20. The end of the return spring 21 that is associated with the cylinder 20 is supported against an outer annular shoulder of this cylinder 20. The cylinder 20 is, in turn, displaceably guided in an outer cylinder 23, to which compressed air can be supplied via a line 24 for acting upon the piston 22. The cylinder 20 has an open base.

The return spring 19 that is associated with the piston 22 has a greater spring stiffness than does the return spring 21 that is associated with the cylinder 20 such that when the piston 22 is acted upon by compressed air, first the second clamping element 18 that is mounted on the cylinder 20 is brought to rest in the clamping position against the first clamping element 17 before subsequently the piston 22, which carries the cutting blade 31, is introduced into the cylinder 20 in order to sever the thread that is fixedly clamped between the two clamping elements 17 and 18.

The housing 11 is furthermore provided with a cylinder chamber 25 that has a compressed air connection 25.1 and in which is accommodated a piston 27 that is displaceable against the force of a return spring 26. Secured to the piston 27 is a piston rod 27.1 that engages against a driving or engagement extension 12.1 of the suction or intake stub 12.

Disposed in the region of the centering plate 4, beyond the traversing path of the traversing thread guide 7, is a thread hold-back element 32 that is movable out of a position that deflects the thread in the direction of the centering plate 4 (see FIG. 1), into a position that releases the thread (see FIG. 3). This thread hold-back element 32 is disposed in an only schematically illustrated manner on a support means 33 that forms a portion of the otherwise non-illustrated machine frame.

For the transfer of a thread to an empty bobbin tube 5, the piston 27 is supplied with compressed air in order to move the suction or intake stub 12, via the engagement extension 12.1, in the direction of the centering plate 4 until the sealing ring 13 comes to rest against the rim of the cylindrical housing 10. Subsequently, the compressed air injector 15 is acted upon by compressed air, so that an intake or suction stream is produced that is effective to the outlet opening of the intake or suction channel 4.1, as a result of which a thread end that is held at this intake or suction channel 4.1 is sucked in until at least in the region of the suction head region 14, a thread having the desired twist is present. In this connection, the thread is held by the hold-back element 32 beyond the traversing path of the traversing thread guide 7. The bobbin creel is thereafter lowered until the bobbin tube 5 rests upon the running friction drive roller 6, as a result of which the bobbin tube is rotated. Simultaneously with the lowering of the bobbin tube 5 upon the friction drive roller 6, by supplying compressed air to the piston 22 the thread is fixedly clamped between the two clamping elements 17 and 18 and is severed by the cutting blade 31 in a direction toward the compressed air injector 15. The thread that is drawn in by the suction, and does not have the required twist, can either be collected centrally or at the spindle in a residual thread container.

The thread, which is guided by the thread hold-back element 32 and is fixedly clamped between the clamping element 17 and 18 is, when the bobbin tube 5 rotates, wound up to form a multi-layer thread reserve FR, as a result of which at the same time the thread reserve is fixed as soon as an adequate thread reserve has been wound up.

The formation of the winding on the tube can thereafter be effected since the thread is clamped and the required winding tension is present.

After the thread hold-back element 32 has released the thread, the thread drops into the traversing thread guide 7 which moves back and forth, and is wound in a conventional manner to form a cross-wound bobbin. As the winding diameter of the cross-wound bobbin increases, the bobbin creel arm 1 is pivoted up in the manner represented by the arrow f4, as a result of which the thread end that is released by the clamping elements 17 and 18 is drawn out of the suction head A. Since the thread is no longer clamped, a free rotation of the start of the thread in the tube shaft, i.e. the hollow shaft 2, can be effected. The suction or intake stub 12 and the clamping/cutting piston 22 are now retracted and the injector is shut off.

The specification incorporates by reference the disclosure of German priority document 103 46 096.9 filed Oct. 4, 2003.

The present invention is, of course, in no way restricted to the specific disclosure of the specification and drawings, but also encompasses any modifications within the scope of the appended claims.

I claim:

1. An apparatus for winding a cross-wound bobbin onto a bobbin tube, comprising:

a bobbin creel comprising at least one bobbin creel arm for the mounting of a bobbin tube centering plate, a thread intake device that is effective in the region of the centering plate and with which is associated a thread severing device, a drive unit for a bobbin shaft/cross-wound bobbin, and a traversing thread guide that is adapted to be driven so as to move back and forth along said bobbin shaft/cross-wound bobbin;

wherein said centering plate is provided with at least one intake or suction channel that is directed radially inwardly from a periphery of said centering plate, wherein said intake or suction channel opens into a hollow shaft that is guided outwardly through an associated one of said bobbin creel arms; and a suction head that is adapted to be placed against said hollow shaft in an axial direction, wherein said suction head is provided with a thread clamping mechanism and said thread severing device.

2. An apparatus according to claim 1, wherein a suction or intake stub, which is displaceable in an axial direction, is mounted in said suction head, and wherein on an end that faces said hollow shaft, said suction intake stub carries a seal.

3. An apparatus according to claim 2, wherein a cylindrical housing is provided that is essentially open at an outer end face thereof, wherein said hollow shaft opens into said cylindrical housing, and wherein said seal is adapted to be brought into engagement against a rim of said cylindrical housing.

4. An apparatus according to claim 2, wherein within said suction head said suction or intake stub opens into a chamber in which is stationarily mounted a first clamping element of said clamping mechanism, wherein a second clamping element of said clamping mechanism is moveable essentially radially relative to an axis of said suction or intake stub and is adapted to be brought into engagement against said first clamping element, and wherein said thread severing device is a cutting blade that is adapted to be introduced essentially radially into said chamber.

5. An apparatus according to claim 4, wherein said second clamping element is secured to a cylinder that is moveable against the force of a return spring, and wherein a piston is guided in said cylinder, wherein said piston carries said cutting blade and is moveable against the force of a further return spring.

6. An apparatus according to claim 5, wherein an end of said further return spring that is associated with said piston is supported against an internal annular shoulder of said piston, and wherein an end of said return spring that is associated with said cylinder is supported against an external annular shoulder of said cylinder.

7. An apparatus according to claim 6, wherein said further return spring that is associated with said piston has a greater spring stiffness than does said return spring that is associated with said cylinder such that upon a supply of compressed air to said piston, first, said second clamping element that is disposed on said cylinder is brought to rest against said first clamping element in a clamping position before subsequently said piston that carries said cuffing blade is introduced into said cylinder in order to sever a thread that is clamped securely in place between said two clamping elements.

8. An apparatus according to claim 7, wherein said cylinder is displaceably guided within an outer cylinder.

9. An apparatus according to claim 2, wherein said suction or intake stub is connected to a source of suction.

10. An apparatus according to claim 9, wherein said source of suction is in a form of a compressed air injector.

11. An apparatus according to claim 1, wherein a thread hold-back element is provided that is disposed in the region of said centering plate beyond a traversing path of said traversing thread guide, and wherein said hold-back element is adapted to be moved out of a position that guides a thread in the direction of said centering plate and into a position that releases said thread.

12. An apparatus according to claim 2, wherein said suction head is provided with a cylinder chamber having a compressed air connection, wherein a piston that is displaceable against the force of a return spring is accommodated in said cylinder chamber, and wherein said piston is provided with a piston rod that engages against a driving or engagement extension of said suction or intake stub.

* * * * *